US005958235A

United States Patent [19]

Leung

[11] Patent Number: 5,958,235

[45] Date of Patent: Sep. 28, 1999

[54] CONTINUOUS-FEED FILTERING- OR SCREENING-TYPE CENTRIFUGE WITH RESLURRYING AND DEWATERING

[75] Inventor: Wallace Woon-Fong Leung, Sherborn, Mass.

[73] Assignee: Baker Hughes Incorporated, Houston, Tex.

[21] Appl. No.: 08/916,660

[22] Filed: Aug. 22, 1997

[51] Int. Cl.[6] ..... B04B 1/00

[52] U.S. Cl. ..... 210/374; 210/360.1; 210/376; 210/380.1; 210/380.3; 210/391; 210/409; 494/36

[58] Field of Search ..... 210/360.1, 374, 210/380.1, 380.3, 391, 409, 376; 494/27, 50, 51, 52, 53, 54, 55, 56, 57, 58, 59, 36

[56] References Cited

U.S. PATENT DOCUMENTS

| | | | |
|---|---|---|---|
| 4,190,194 | 2/1980 | Amero | 494/53 |
| 4,298,159 | 11/1981 | Epper et al. | 494/53 |
| 4,434,052 | 2/1984 | Milhaupt | 210/376 |
| 5,403,486 | 4/1995 | Leung | 210/512.1 |
| 5,653,673 | 8/1997 | Desai et al. | 494/27 |

FOREIGN PATENT DOCUMENTS

| | | |
|---|---|---|
| 40 33 012 | 4/1992 | Germany . |
| 2064 997 | 12/1979 | United Kingdom . |

*Primary Examiner*—David A. Reifsnyder
*Attorney, Agent, or Firm*—R. Neil Sudol; Henry D. Coleman

[57] ABSTRACT

In a continuous-feed filtering- or screening-type centrifuge, first dewatering a particulate material, then reslurrying the particulate material, and subsequently again dewatering the particulate material in a sequence along a cake flow path extending through the continuous-feed filtering- or screening-type centrifuge. The first dewatering, the reslurrying and the subsequent dewatering are performed in respective compartments disposed along the cake flow path. The compartments are defined in part by a plurality of gates, baffles, or weirs extending outwardly from a hub of the centrifuge. Outer ends of the gates are spaced from a bowl wall to define respective cake flow gaps which limit the thickness of a cake layer moving along the cake flow path.

23 Claims, 10 Drawing Sheets

CONTINUOUS-FEED FILTERING- OR SCREENING-TYPE CENTRIFUGE WITH RESLURRYING AND DEWATERING

BACKGROUND OF THE INVENTION

This invention relates to continuous-feed filtering- or screening-type centrifuges. This invention also relates to an associated centrifuge method.

Industrial centrifugation processes for separating particulate material from various impurities include sedimentation and filtration. Generally, the particulate material is produced as a cake having different degrees of moisture depending on the type of particulate material and the particular separation process. The cake constitutes a heavy phase whereas the impurities are removing in a filtrate constituting a light phase.

A decanter-type centrifuge has a conveyor in the form of one or more helical screw wraps rotating at a slightly different angular velocity from the velocity of the bowl or outer wall. Where the bowl has a solid wall with a cylindrical shell followed by a conical shell and extends from a clarifier pool at an input or feed end of the centrifuge to a cake discharge opening or openings at an output end of the centrifuge, the centrifuge is known as a decanter or a solid bowl. A sedimentation process occurs in the cylindrical portion of the centrifuge and a dewatering of the cake in the conical dry beach area. Where the bowl is provided with one or more screen sections downstream and outside of the clarifier pool, the decanter-type centrifuge is known as a screenbowl centrifuge and performs a filtration process.

Another kind of filtration centrifuge is a pusher or pusher basket. Such a centrifuge includes a first cylindrical basket at an input end of the centrifuge and a second cylindrical basket of greater diameter at a cake output end of the centrifuge. The baskets rotate at a high angular speed. In addition, the baskets of this two-stage basket system are longitudinally reciprocatable relative to one another, whereby pusher plates shove the heavy phase particulate material in a layer along the first basket, from the first basket to the second basket, and along the second basket to a cake discharge port. Single-stage pushers or pushers with two-or-more stages such as quadruple-stage pushers are also available.

Filtering centrifuges have been used to wash the cake to remove the impurities. There are two types of washing: a spray wash and a flood wash. In a spray wash, wash liquid is applied to a localized area on the cake surface in an attempt to displace mother liquor which contains the impurities. Spray washing is used most commonly in a screen-bowl centrifuge where the cake height varies across the screen from a thin layer to a thick layer adjacent to the pressure face of the conveyor blade.

Another kind of centrifuge, used particularly for the dewatering and washing of thickened slurries with particulate solids, is a conical-screen centrifuge. The centrifuge wall includes a conical screen which has an increasing diameter in the cake flow direction. The particulate solids are held by the screen as the liquid filters through. The conical screen has the advantage that the cake experiences an increasing centrifugal gravitational force as the cake travels down to the large diameter of the cone. The centrifugal gravity is proportional to the radius of the screen for a given rotational speed of the basket. Another advantage of the increasing-diameter conical screen is that, for a given cake mass, the cake height is reduced as the cake moves towards the large-diameter end of the cone, owing to the conservation of mass. Both of these advantages enhance the dewatering of the cake. Also, spray washing is used in conical-screen centrifuges to remove impurities dissolved in the mother liquor.

In a conical-screen centrifuge, a thickened or concentrated feed is introduced, after pre-acceleration to the proper tangential speed, into the centrifuge at the smaller end of the conical screen. The cake travels down the cone when the half cone angle, typically 30° to 40° with respect to the axis of the machine, is steep enough to overcome frictional forces.

When the cone angle is small, typically 15° to 25°, a mechanical conveyance mechanism is used to convey, the cake from the small end of the cone to the large end thereof One mechanism is a helical screw conveyor with a single continuous lead. Another, related, mechanism is a multiple-lead screw conveyor (4 leads is common). Yet another mechanism is a set of discrete scraper blades each conforming to a helix. In any case, the conveyor rotates at a differential speed as compared to the screen, thereby conveying cake down the screen. By adjusting the differential speed, the cake movement and concomitantly the cake residence time can be adjusted. Another mechanism is a vibrator, such as rotation of eccentric weights with an axis of vibration parallel to the axis of the machine. The inertia force generated by the vibration propels the cake from the small end to the large end, the discharge end, of the centrifuge.

FIG. 1 is a schematic drawing of a conventional screen-bowl centrifuge. A bowl 20 has a solid cylindrical portion 22 at an input end of the centrifluge. Input of a slurry is effectuated via a feed pipe 24 and an outlet opening 26 into a feed compartment 24*a* where the feed is accelerated to tangential speed before it is discharged through feed ports 26*a*. The accelerated slurry is fed to an annular pool 28 in which clarification and sedimentation occurs. Pool 28 is located in the solid cylindrical portion 22 of bowl 20 and overlaps a solid beach portion 30 of the bowl. After a cake layer 32 is formed, it is conveyed by a helical conveyor blade 34 out of the pool 28 up the conical beach 30 to a cylindrical screen section 36. In a first portion of the screen 36, wash liquid 38 is introduced to remove the mother liquor containing the dissolved impurities.

FIG. 2 is a schematic cross-section of the helical conveyor blade 34 and screen 36 and shows a cake profile 40 formed adjacent to a pressure face 42 of the blade. Wash liquid 38 is applied through a wash nozzle assembly 44 (FIG. 1) or 44' through a conveyor hub 46. A remaining portion of the screen 36 is used for ultimate dewatering of both the mother liquor and more importantly the wash liquid which displaces the mother liquor in the first portion of the screen so as to obtain both pure and dry cake from the centrifuge.

Improved spray wash nozzle designs and methods disclosed respectively in U.S. Pat. No. 5,403,486 and U.S. Pat. No. 5,527,474 provide wash liquid which has a wider area of coverage on the cake surface and has a tangential velocity matching that of the cake so that the wash liquid attains the same centrifugal gravity as that of the cake. Otherwise, the wash liquid enters the centrifuge as a lighter fluid situated above the heavier cake profile and does not penetrate and wash the cake.

On the other hand, flood washing is more effective in providing a pool of wash liquid used to displace the mother liquor. Flood washing is most commonly used when operating with a uniform cake such as found in a continuous pusher or batch baskets. However, flood washing still does not provide a satisfactory wash at times insofar as some of the areas in the porous cake can be excluded from being swept such as dead pockets or zones. Also, fingering or channeling further reduces the wash liquid sweeping efficiency. In contrast, spray washing does not warrant wash on a larger surface area as with a flood wash. In addition, given the angle of repose (see FIG. 2), the wash liquid runs down the cake to the screen section, bypassing the cake interior entirely. This result is more probably the case when the wash liquid is not accelerated to speed. Even when the wash liquid is accelerated to the speed of the cake, a jet of wash liquid with high radial momentum is likely to shoot the cake solids, especially the fines, through the screen, thereby defeating the purpose of the spray wash.

For porous cake with a rough particle surface, the impurities are trapped and it becomes difficult to remove these impurities with either conventional spray washing or flood washing. As illustrated in FIG. 3, the cake is conventionally reslurried in a mixing or repulping tank 48 and sent to a centrifuge 50 for dewatering. A feed concentrate with high impurities is delivered to repulping tank 48 via an inlet 52, while a wash liquid with low impurities is input at 54. The reslurried cake is conveyed from repulping tank 48 to centrifuge 50. Centrifuge 50 outputs purified cake with low impurities and a filtrate or spent wash liquid, respectively represented by arrows 58 and 56. As shown in FIG. 4, this reslurrying-and-separation may repeated in one or more subsequent stages, each stage including a mixing or repulping tank 60 and a centrifuge 62, until the impurities are removed to within specification. Filtrate from a subsequent centrifuging operation may be fed back to a repulping tank, as indicated at 64.

SUMMARY OF THE INVENTION

The present invention provides an improved continuous-feed filtering- or screening-type centrifuge and an associated centrifuge method. The method comprises first dewatering a particulate material, then reslurrying the particulate material, and subsequently again dewatering the particulate material in a sequence along a cake flow path extending through the continuous-feed filtering- or screening-type centrifuge. It is contemplated that the first dewatering, the reslurrying and the subsequent dewatering are all carried out in the same centrifuge and are performed in respective compartments disposed along the cake flow path.

Preferably, the compartments in the centrifuge are defined in part by a plurality of gates, baffles, or weirs extending outwardly from a hub of the centrifuge. Outer edges of the gates extend generally parallel to a bowl surface and are spaced therefrom to define respective cake flow gaps which limit the thickness of a cake layer moving along the cake flow path. Generally, the particulate material will move in a layer of substantially uniform thickness through the cake flow gaps.

In accordance with another feature of the present invention, the subsequent dewatering produces a filtrate which is used in the reslurrying of the particulate material. The filtrate is recycled back and added to the particulate material in the reslurrying compartment to resuspend the particulate material. This countercurrent wash method results in a substantial saving of "fresh" wash liquid yet provides for effective removal of the impurities.

A continuous-feed filtering- or screening-type centrifuge for performing the above-delineated method comprises, in accordance with the present invention, a series of compartments disposed along a cake flow path extending through the conveyor. A first compartment of the series of compartments has an outer wall formed at least partially as a screen to enable dewatering of particulate material traveling through the first compartment along the cake flow path. A second compartment of the series of compartments is disposed downstream of the first compartment along the cake flow path and has an effectively imperforate outer wall and a liquid feed for reslurrying or resuspending the particulate material in the second compartment. A third compartment of the series of compartments is disposed downstream of the second compartment along the cake flow path and has an outer wall formed at least partially of a screen to enable dewatering of particulate material traveling through the third compartment along the cake flow path.

It is to be noted that the reslurrying and dewatering actions may each be performed several times in a single centrifuge. In that event, the centrifuge is provided with multiple reslurrying compartments and multiple dewatering compartments interleaved with one another along the cake flow path.

Where the centrifuge is a screenbowl decanter-type centrifuge having a bowl with a conical beach section, the compartments may be disposed at least partially along the beach section. In a screenbowl centrifuge where the bowl has a conical beach and a cylindrical bowl wall located downstream of the conical beach along the cake flow path, the reslurrying and dewatering compartments may be disposed in the conical beach and/or the cylindrical bowl wall.

It is possible for a centrifuge to perform the reslurrying and dewatering method of the present invention even if the outer walls of the reslurrying compartment or compartments are not completely imperforate and even if the outer walls of the dewatering compartments are not entirely formed of filter screens. To accomplish the reslurrying, it is only necessary that the outer walls of the reslurrying compartment or compartments are sufficiently solid or imperforate ("effectively imperforate") to permit a resuspension of the particulate material. Similarly, to accomplish the dewatering, it is only necessary that the outer walls of the dewatering compartments have enough perforated or screen-type area to enable effective drainage of filtrate from the particulate material to form a dewatered cake substantially free of moisture.

As discussed above with respect to the method of the present invention, the compartments of the centrifuge are defined in part by a plurality of gates, baffles, or weirs extending outwardly from a hub of the centrifuge. In a screenbowl centrifuge having a conveyor with one or more screw wraps for pushing the particulate material in a layers along the cake flow path, the gates may extend substantially perpendicularly to the conveyor wrap or wraps. Alternatively, the gates may extend substantially in transverse planes relative to the hub.

Generally, a screenbowl centrifuge in accordance with the present invention will have a bowl provided in a conical beach and/or a cylindrical bowl wall downstream thereof with a plurality of annular solid bands or circumferentially extending solid bowl sections interleaved in the axial direction with a plurality of annular screen sections or circumferentially extending perforate screen sections. Typically, a conveyor in such a centrifuge has a plurality of interleaved screw wraps extending at an angle relative to the solid bowl sections and the perforate screen sections. The compartments are separated from one another by a plurality of entrance and exit gates extending outwardly from the centrifuge hub and connected to the wraps.

In one specific embodiment of a decanter centrifuge in accordance with the invention, the gates are spaced from one another at irregular intervals so that the outer wall of each reslurrying compartment is completely solid or imperforate. In this embodiment of the invention, the outer wall of each dewatering compartment has a screen or perforate portion and two solid portions.

In another specific embodiment of a decanter centrifuge in accordance with the present invention, the gates are spaced at equal distances from one another along the spiral of the conveyor wraps and the centrifuge bowl is provided with substantially solid triangular sections contiguous with at least one of the solid bowl sections to render the outer wall of the second compartment completely solid or imperforate.

As stated above, the gates in a decanter centrifuge pursuant to the present invention may be substantially circumferential and lie in transverse planes substantially perpendicular to the hub and the axis of the machine. In such a decanter centrifuge, the outer wall of each reslurrying compartment is completely solid or imperforate while the outer wall of each dewatering compartment is completely in the form of a screen.

A centrifuge in accordance with the present invention may be a pusher-type centrifuge. In that case, the centrifuge includes a cylindrical first basket and a cylindrical second basket disposed downstream of the first basket along the cake flow path. The first basket has a smaller diameter than the second basket. The centrifuge also includes pushers for pushing cake along the first basket and the second basket. The baskets have a plurality of circumferentially extending solid bowl sections alternating with circumferentially extending perforate screen sections, while a plurality of circumferential and radial gates are disposed at junctions between adjacent solid bowl and perforate screen sections.

Spray nozzles may be provided in the dewatering compartments for spraying the particulate material during dewatering thereof.

A continuous-feed filtering- or screening-type centrifuge comprise, in accordance with another embodiment of the invention, a series of compartments disposed along a cake flow path, a first compartment of the series of compartments having an effectively imperforate outer wall and a liquid feed for reslurrying or resuspending the particulate material in the first compartment, and a second compartment of the series of compartments being disposed downstream of the first compartment along the cake flow path and having an outer wall formed at least partially as a screen to enable dewatering of particulate material traveling through the first compartment along the cake flow path. The first compartment may contain a clarifier pool and a beach area, the liquid feed being disposed downstream of the beach area along the cake flow path. The series of compartments may additionally include a third compartment disposed downstream of the second compartment along the cake flow path and having an effectively imperforate outer wall and a liquid feed for reslurrying or resuspending the particulate material in the third compartment. Also, a fourth compartment may be disposed downstream of the third compartment along the cake flow path and having an outer wall formed at least partially as a screen to enable dewatering of particulate material traveling through the fourth compartment along the cake flow path.

A method and associated centrifuge in accordance with the present invention produces a drier purer cake.

One effect of the gates is to produce a more uniform cake distribution in both the dewatering and the reslurrying compartments. This allows for a more effective dewatering and an improved removal of impurities in the dewatering compartments. A more uniform cake in the reslurrying compartments allows the wash liquid to penetrate the entire cake surface evenly. Otherwise, if the cake has a non-uniform topography, wash liquid tends to flow to those cake areas having the lowest elevations. The gates also enhance shear and churning action in the cake, which rearranges the cake and eliminates dead pockets which trap moisture and impurities.

Cake has a longer residence time for washing in a centrifuge according to the invention owing to withholding from the gates.

DESCRIPTION OF THE PREFERRED EMBODIMENTS

Figure 1:
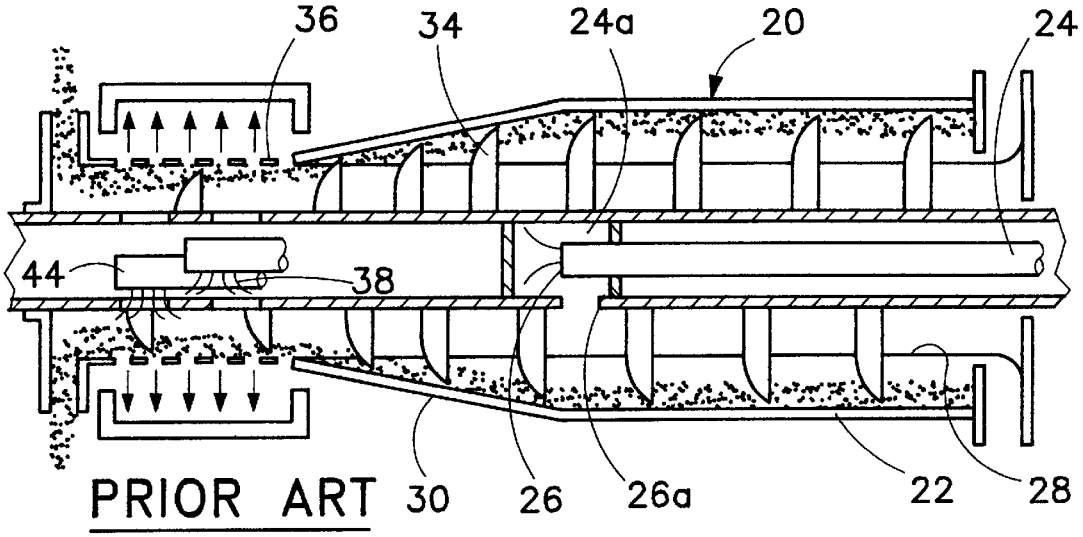
PRIOR ART FIG. 1
FIG. 1 is a schematic longitudinal cross-sectional view of a screenbowl centrifuge according to the prior art.
Figure 2:
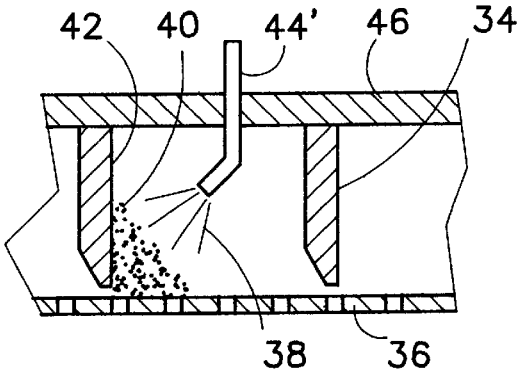
PRIOR ART FIG. 2
FIG. 2 is a schematic partial longitudinal cross-sectional view of a prior-art screenbowl centrifuge on a larger scale than FIG. 1, showing a cake distribution against a conveyor blade.
Figure 3:
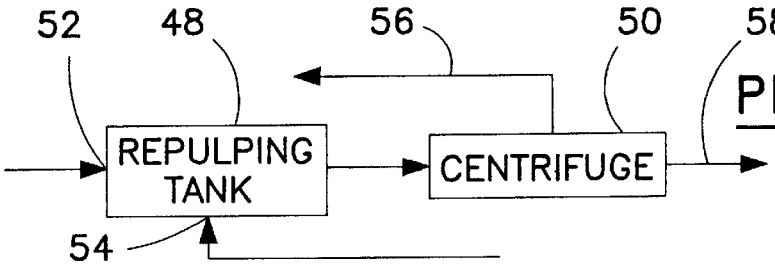
PRIOR ART FIG. 3
FIG. 3 is a block diagram of a conventional single-stage system for reslurrying cake to enhance the removal of impurities.
Figure 4:
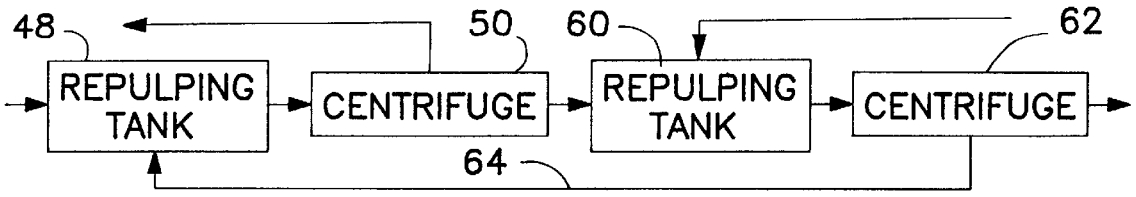
PRIOR ART FIG. 4
FIG. 4 is a block diagram similar to FIG. 3, showing a conventional two-stage system for reslurrying cake to enhance the removal of impurities.
Figure 5:
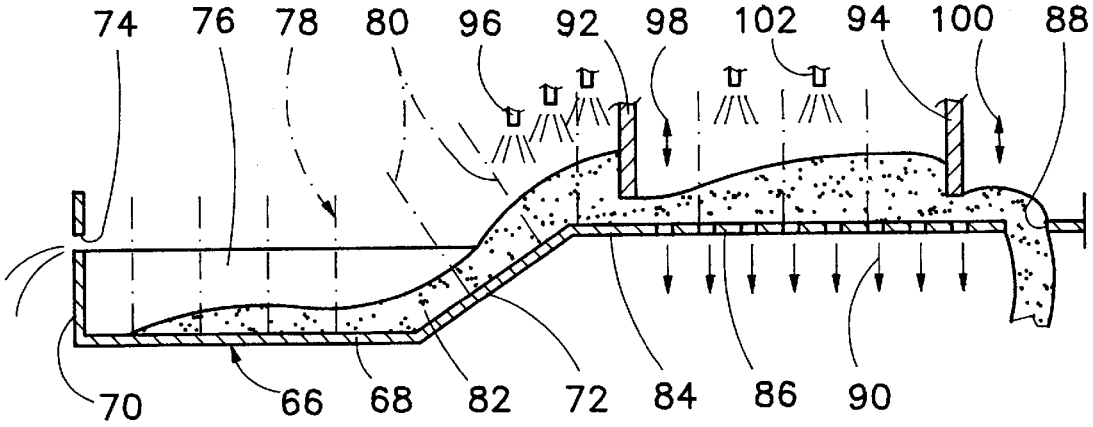
FIG. 5 is a schematic longitudinal cross-sectional view of a screenbowl centrifuge in accordance with the present invention.

As diagrammatically illustrated in FIG. 5, a screenbowl centrifuge includes a bowl 66 with a cylindrical section 68 connected on one side to a transverse wall 70 and on an opposite side to a conical beach 72. Transverse wall 70 is provided with a liquid discharge opening 74 having a radial location which defines the depth of a clarifier or separation pool 76. A conveyor 78 having one or more helical screw wraps 80 rotates at a slightly different velocity from that of bowl 66 to push particulate material or cake 82 from pool 76 and along beach 72 to a smaller-diameter cylindrical bowl section 84 disposed on a side of beach 72 opposite to pool 76 and cylindrical section 68. During the negotiation of beach 72, the particulate material or cake 82 is dewatered, with excess fluid flowing back into pool 76.

In response to the differential speed of conveyor 78 relative to bowl 66, cake 82 is pushed along cylindrical bowl section 84 and over a cylindrical screen section 86 to a cake discharge port at 88. During its passage over screen section 86, cake 82 is dewatered owing to desaturation, i.e., the ejection of liquid through screen section 86, as indicated by arrows 90.

Screen section 86 is flanked on an upstream downstream side by an outlet on a downstream side by an outlet gate 94, as determined by the direction of cake flow. Gate 92 cofunctions with the differential speed of conveyor 78 relative to bowl 66 to control the amount of cake released to screen section 86, while gate 94 cofunctions with the differential speed of conveyor 78 relative to bowl 66 to control the retention time of the cake on the screen and the rate of cake discharge through port 88. It is to be noted here that cylindrical bowl section 84 extends past gate 92, for preventing the discharge of fine particulate matter through screen section 86.

Upstream of gate 92, flood wash feed nozzles 96 are provided for reslurrying the particulate material or cake 82 after the initial dewatering and prior to further dewatering in the screen area of the bowl. This flood wash fluidizes cake 82 and also serves to enhance and displace the contaminated mother liquor, which flows back down into clarifier pool 76. Accordingly, the cake conveyed downstream past gate 92 to screen section 86 has a reduced impurities content. Gate 92 permits only the cake layer adjacent to cylindrical bowl section 84 to pass to the subsequent dewatering stage. This cake layer is the driest.

Exit or outlet gate 94 controls the cake profile at the outlet end of screen section 86 and also controls the residence time of the cake on screen section 86 so as to maximize the dewatering of the cake on screen section 86. Gates 92 and 94 separate centrifuge bowl 66 into two compartments. In the first compartment, upstream of gate 92, dewatering of cake 82 occurs on beach 72 and reslurrying takes place on cylindrical bowl section 84. In the section compartment, between gates 92 and 94, dewatering is effectuated via screen section 86.

It is to be noted that gates 92 and 94, as well as similar gates disclosed hereinafter with reference to other embodiments of the invention, are radially adjustable, as indicated by arrows 98 and 100. It is contemplated that the radial positions of gates 92 and 94 are adjustable from outside the machine without requiring a dismantling thereof. Various mechanisms for implementing such adjustability are disclosed in U.S. Pat. No. 5,643,169, the disclosure of which is hereby incorporated by reference.

The dewatering compartment defined by screen section 86 and gates 92 and 94 is optionally provided with spray nozzles 102. The spray wash provided by nozzles 102 is more effective than conventional spray washes insofar as the cake over screen section 86 is more uniformly distributed than in conventional centrifuges owing to the leveling effect of gate 92.

Figure 6:
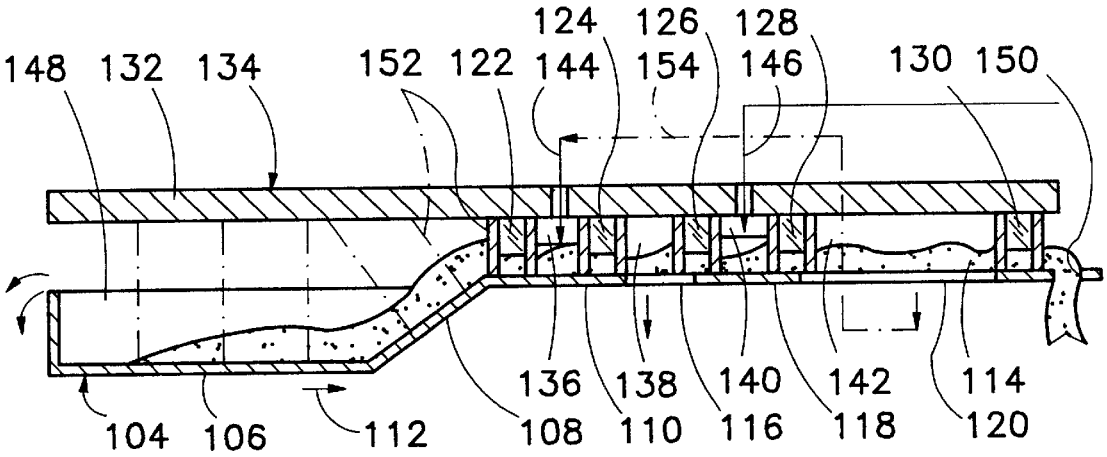
FIG. 6 is a schematic longitudinal cross-sectional view of another screenbowl centrifuge in accordance with the present invention.

As illustrated in FIG. 6, a screenbowl-type decanter centrifuge has a bowl 104 with a first cylindrical solid bowl section 106 connected at one end to a conical beach 108 in turn connected to a second cylindrical solid bowl section 110. Bowl section 110 is contiguous, on a downstream side as determined by a direction 112 of flow of a layer of particulate material or cake 114, with an annular or cylindrical screen section 116. On a downstream side of screen section 116 is provided another cylindrical solid bowl section 118 and then another annular or cylindrical screen section 120. A series of radially adjustable gates, 122, 124, 126, 128, and 130 depending from a hub 132 of a conveyor 134 are positioned generally at the junctions between the successive cylindrical bowl sections 110, 116, 118, and 120 downstream of beach 108 to define therewith a series of compartments 136, 138, 140, and 142. Compartments 136 and 140 are provided with nozzles or passageways 144 and 146 (diagrammatically represented by arrows indicating fluid flow) extending through the conveyor hub for introducing wash liquid into those compartments for purposes of reslurrying cake 114 during its transit along a cake flow path (see direction of flow arrow 112) from a clarifier pool 148 at one end of the centrifuge to a cake discharge opening or openings 150 at an opposite end of the centrifuge.

Conveyor 134 includes one or more screw wraps 152 for pushing cake 114 along the cake flow path identified by cake flow direction 112. As described in detail hereinafter, gates 122, 124, 126, 128, and 130 are contiguous with and movably connected to conveyor wraps 152. Gates 122, 124, 126, 128, and 130 establish entrance and exits openings for the various interleaved compartments 136, 138, 140, and 142 and control cake thickness at the entrance sides of the compartments. As discussed above with reference to FIG. 5, low-rate spray nozzles (not shown) may be provided in dewatering compartments 138 and 142. Gates 124 and 128 induce the cake in compartments 138 and 142 to have a uniform thickness, thereby facilitating or enhancing the removal of residual mother liquor through drainage in those compartments. On the other hand, gates 122 and 1126 induce the cake in compartments 136 and 140 to have a uniformity, thereby facilitating reslurring of the particulate matter by the wash liquid. The uniform cake thickness allows a better reslurrying as channeling through thinner cake is not possible.

As cake 114 is conveyed along cake flow path 112, it is dewatered first in beach section 108, then reslurried in compartment 136, dewatered or desaturated in compartment 138, reslurried again in compartment 140, and finally dewatered or desaturated again in compartment 142. As indicated by phantom line 154, liquid extracted from cake 114 via screen section 120 may be returned as wash liquid to compartment 136 via nozzle 144 to wash the cake upstream, i.e., in a countercurrent washing with the wash liquid becoming increasingly saturated with impurities as the wash travels upstream while the cake becomes increasingly pure after each wash in traveling downstream towards the cake exit.

It is to be understood that solid bowl sections 110 and 118 may be formed as blinds which are inserted into bowl 104 to overlie spaced cylindrical portions of a single screen at the output end of the machine. This manner of assembly is especially appropriate in retrofits. Of course, solid bowl sections 110 and 118 may be solid cylindrical plates like bowl section 106. It is accordingly clear that the term "solid bowl section" as used herein is meant to denote plate sections of a centrifuge bowl and sections of a screen bowl covered with blinds to render those sections effectively solid for purposes of permitting reslurrying of materials.

In using such a counter-current reslurry/wash, incoming fresh wash liquid is used to flood wash the exiting cake in compartment 140 and, optionally, to spray wash the exiting cake in compartment 142. Filtrate is collected and used to reslurry/wash the cake further upstream. Filtrate obtained from upstream dewatering compartment 138 via screen section 116 is concentrated in impurities and is discarded.

Figure 7:
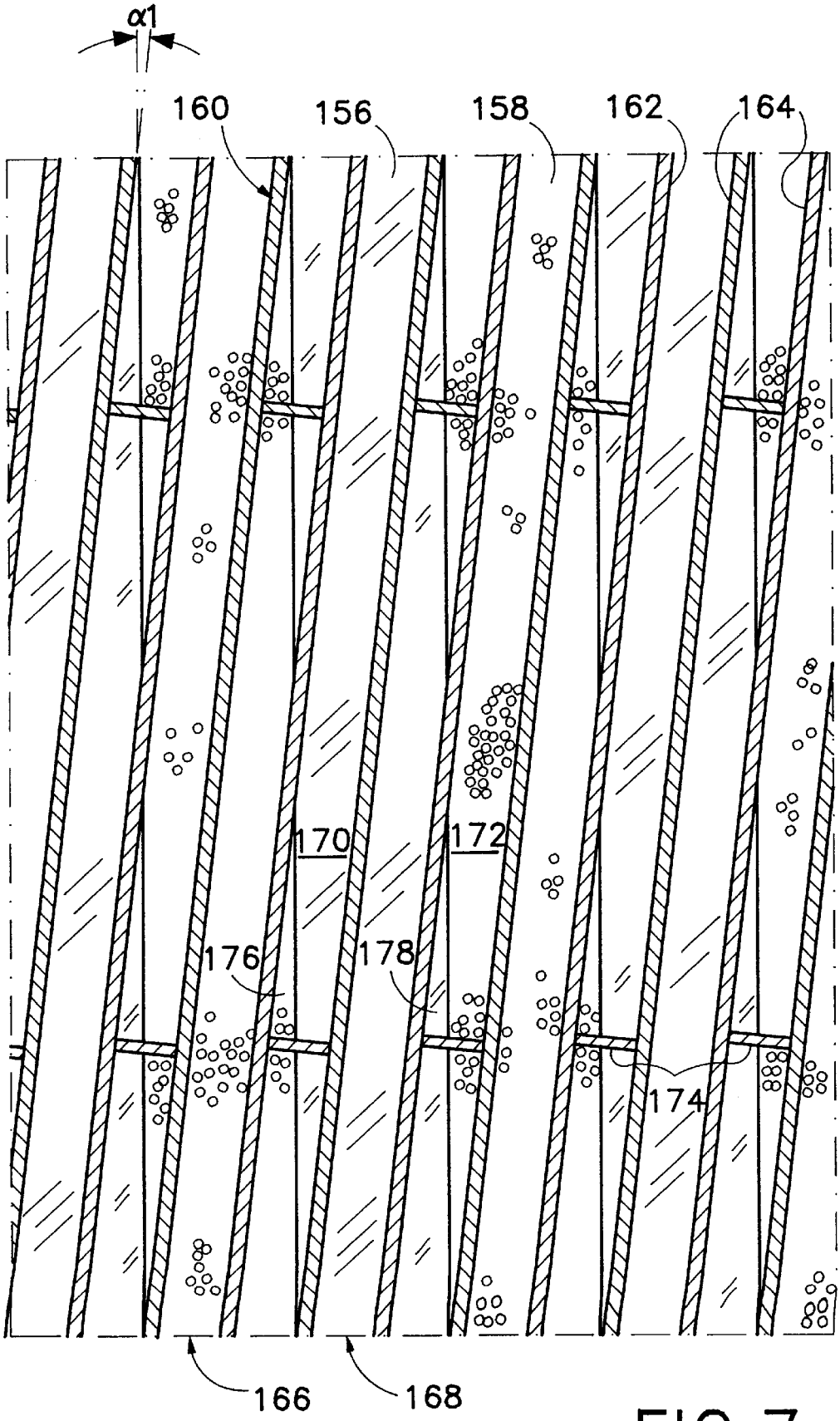
FIG. 7 is a schematic unwrapped or developed view of a screenbowl centrifuge in accordance with the present invention, showing the placement of gates relative to alternating cylindrical solid bowl sections and screen sections.

FIG. 7 depicts an unwrapped or developed bowl of a screenbowl centrifuge wherein the bowl is provided in a conical beach and/or a cylindrical bowl wall downstream thereof with a plurality of annular solid bands or circumferentially extending solid bowl sections 156 interleaved in the axial direction with a plurality of annular screen sections or circumferentially extending perforate screen sections 158. A conveyor 160 has a plurality of interleaved screw wraps 162 and 164 extending at an angle a1 relative to the solid bowl sections 156 and the perforate screen sections 158. Screw wraps 162 and 164 define a plurality of helical channels 166 and 168 along which cake flows from a clarifier pool and beach (neither shown) to a cake discharge port (also not shown). Along each channel, plural reslurrying compartments 170 and multiple dewatering compartments 172 alternating with one another in a cake flow direction are defined in part by radially adjustable entrance and exit gates 174 which are contiguous with and extend substantially perpendicularly to wraps 162 and 164. Gates 174, formed as baffle plates, extend outwardly from a centrifuge hub (not shown) and are connected to wraps and 1and 164. Cake flows through the opening formed between the bowl wall and the free edges of the gates.

As shown in FIG. 7, due to the helix geometry, end effects arise which are associated with the entrance and exit of each compartment 170 and 172. These end effects include the disposition of either a triangular perforate wall area 176 in a reslurrying compartment 170 or a solid wall area 178 in a dewatering compartment 172. FIGS. 8, 9, 10 and 11 depict different techniques for eliminating these end effects. In FIGS. 8, 9, 10, and 11, reference numerals from FIG. 7 are used to designate the same structural elements as in FIG. 7.

Figure 8:
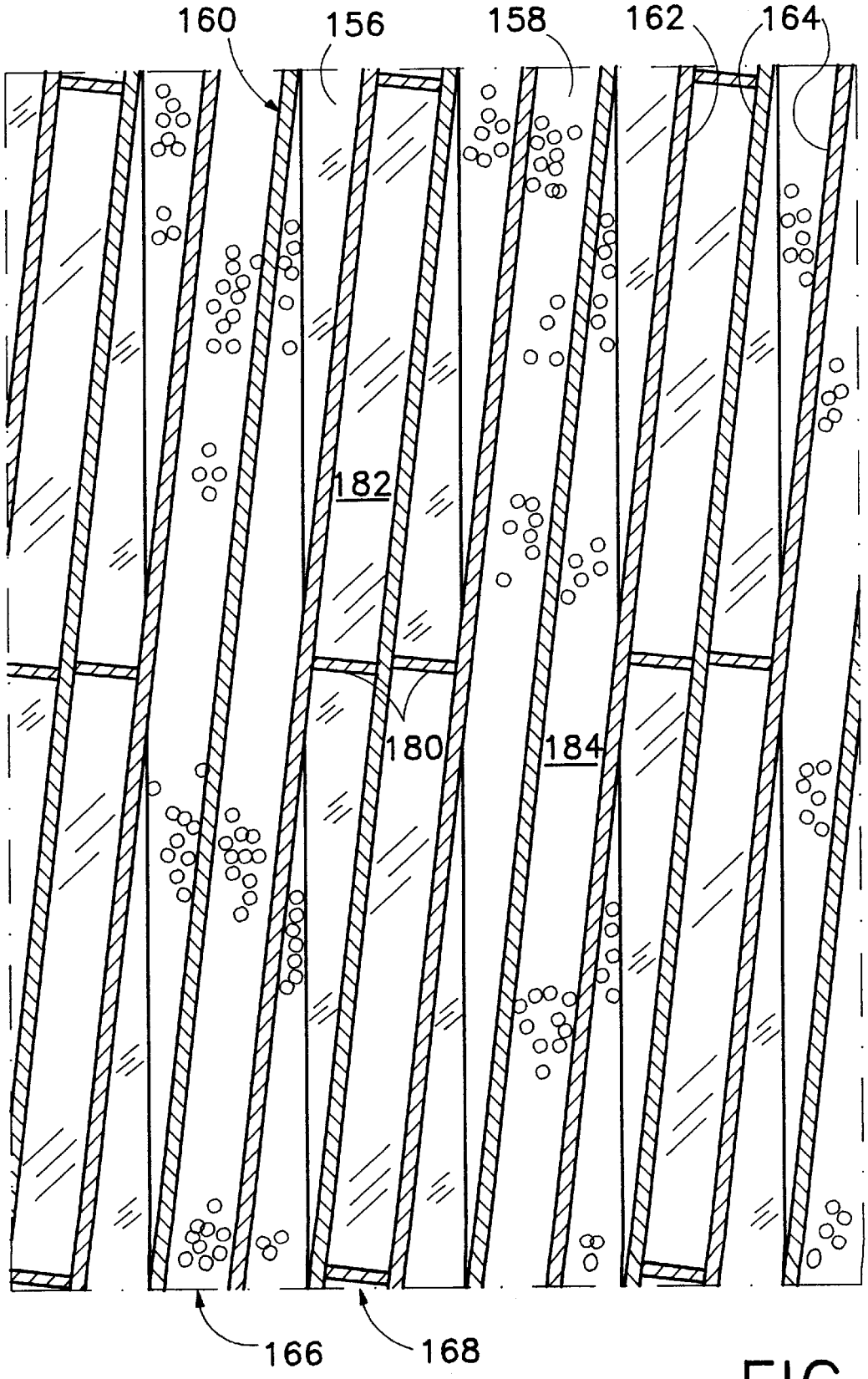
FIG. 8 is a schematic unwrapped or developed view similar to FIG. 7, showing an alternative placement of gates relative to alternating cylindrical solid bowl sections and screen sections.

As illustrated in FIG. 8, gates 180 are installed which are so located as to form reslurrying compartments 182 having bowl walls which are completely solid. Thus, gates 180 are shifted relative to gates 174 to eliminate triangular perforate areas 176. Reslurrying compartments 182 in the embodiment of FIG. 8 are shorter than reslurrying compartments 170 in FIG. 7. Concomitantly, dewatering compartments 184 in FIG. 8 are longer than dewatering compartments 172 in FIG. 7. In this embodiment of a screenbowl centrifuge, the outer wall of each dewatering compartment 184 has a screen or perforate portion and two triangular solid portions.

Figure 9:
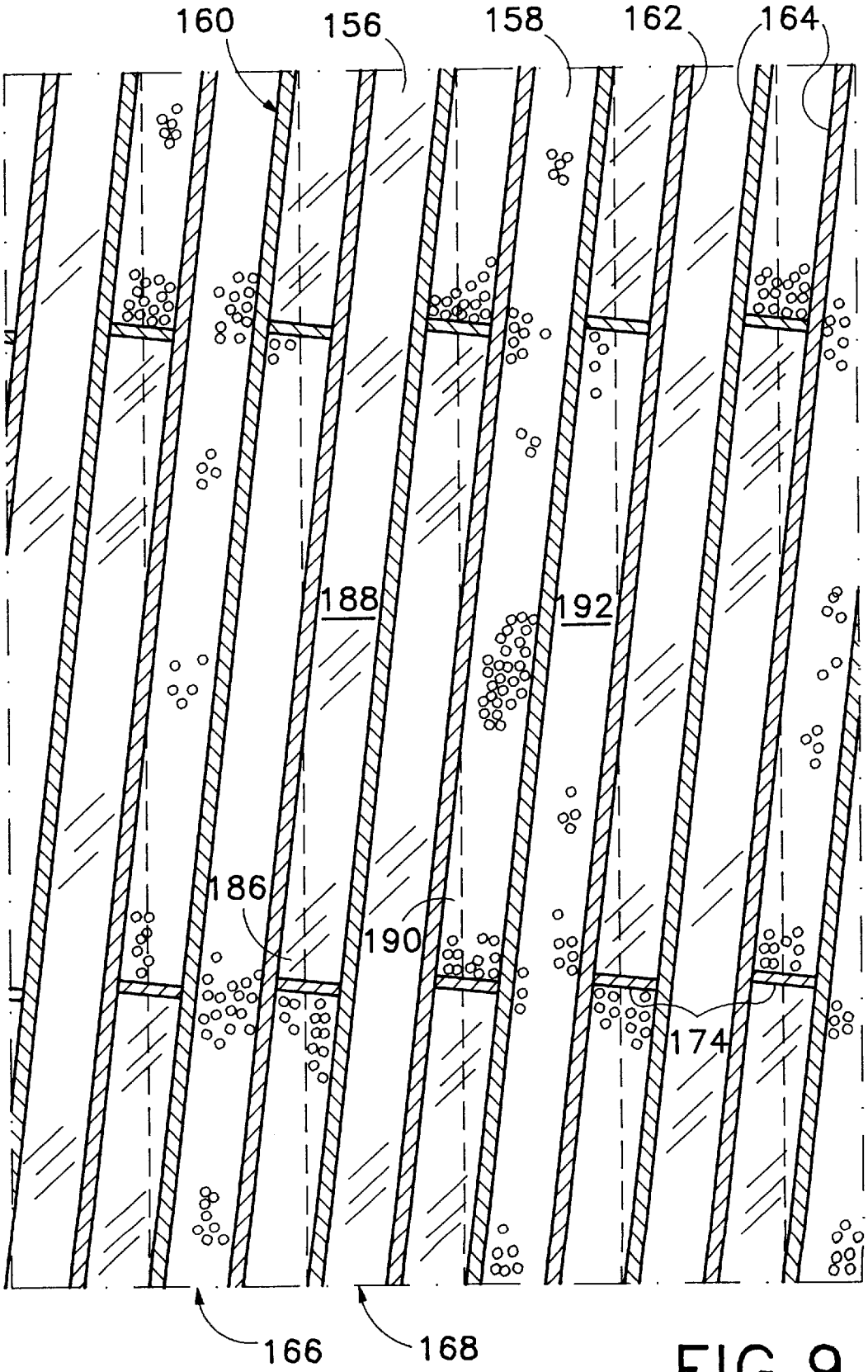
FIG. 9 is a schematic unwrapped or developed view similar to FIG. 7, showing modifications to the cylindrical solid bowl sections and screen sections of FIG. 7.

As shown in FIG. 9, triangular perforate wall areas 172 (FIG. 7) may be replaced with respective triangular solid sections or plates 186, thereby forming reslurrying compartments 188 which have radially outer walls which are completely solid. Similarly, triangular solid areas 178 (FIG. 7) are replaced with triangular perforate sections or screens 190, thereby forming dewatering compartments 192 whose radially outer walls are entirely perforated. Compartments 188 and 192 may have the same length as compartments 170 and 172, respectively.

Figure 10:
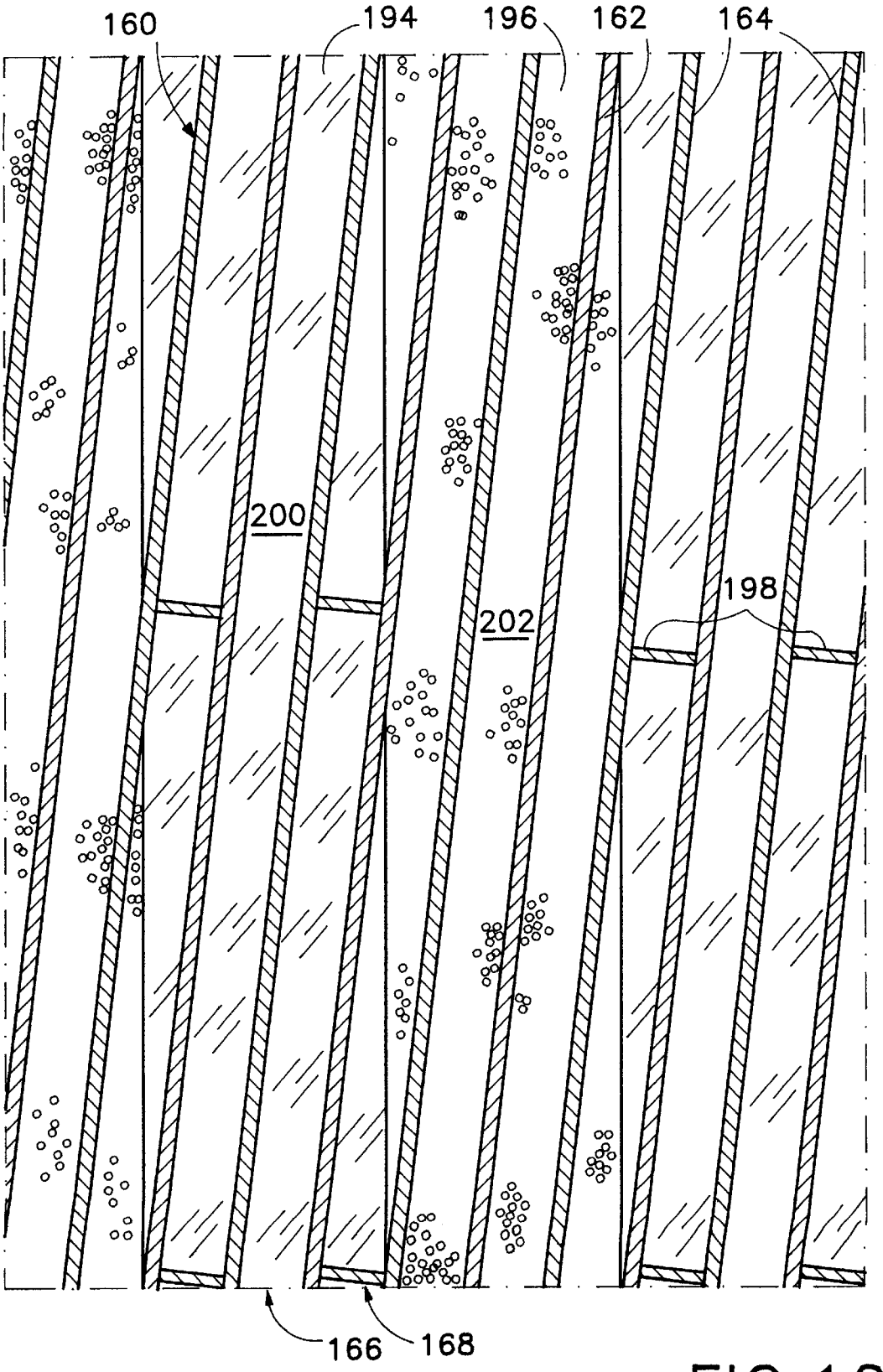
FIG. 10 is a schematic unwrapped or developed view similar to FIG. 7, showing an alternative solid bowl sections and screen sections having a different width relative to a distance between successive conveyor screw flights.

As depicted in FIG. 10, the centrifuge bowl wall can be formed with alternating cylindrical solid sections 194 and cylindrical screen sections 196 which are wider relative to the width of channels 166 and 168, i.e., relative to the separation of adjacent conveyor wraps 162 and 164. The increase in bowl section width together with the placement of gates or baffles 198 produces longer reslurrying compartments 200 and longer dewatering compartments 202, relative to compartments 170 and 172 in FIG. 7. Gates 198 may be placed, as discussed above with reference to FIG. 8, to eliminate vestigial perforate areas in reslurrying compartments 200.

Figure 11:
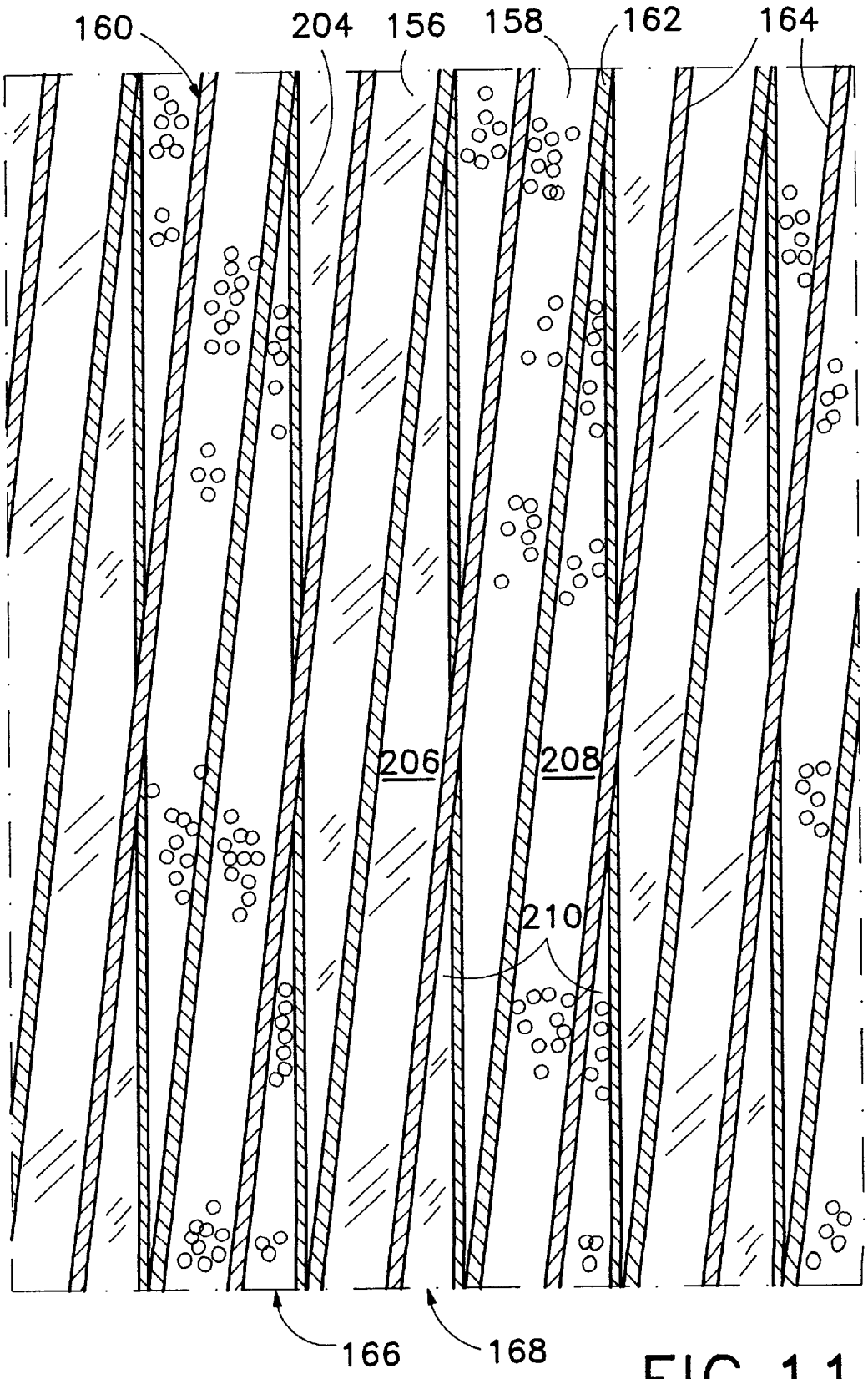
FIG. 11 is a schematic unwrapped or developed view similar to FIG. 7, showing alternative gates extending circumferentially, rather than perpendicularly to conveyor flights.

Another arrangement which eliminates the end effects is the use of circumferential gates or weirs 204 to produce reslurrying and dewatering compartments 206 and 208, as shown in FIG. 11. Unlike with perpendicular gates 174, 180, and 198, the cake in the embodiment of FIG. 11 sees non-uniform resistance as it meets circumferential weirs 204, producing the undesirable consequence of cake jamming in corners 210.

Figure 12:
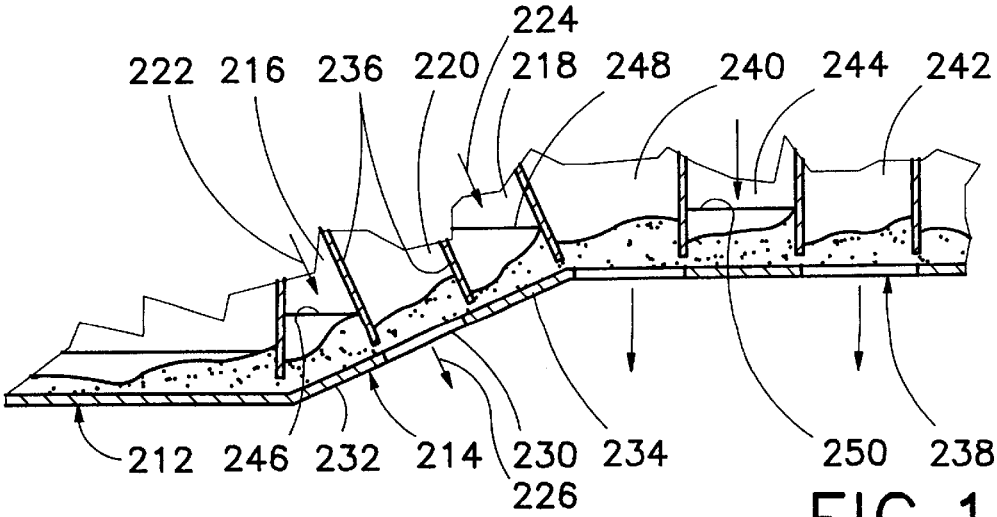
FIG. 12 is a schematic partial longitudinal cross-sectional view of another embodiment of a centrifuge in accordance with the present invention, showing reslurrying and separation in conical and cyindrical bowl sections above an annular separation pool.

As illustrated in FIG. 12, a bowl 212 of a screenbowl centrifuge may be provided along a beach 214 with one or more reslurrying compartments 216 and 218 and one or more dewatering compartments 220 interleaved or alternating with the reslurrying compartments. Flood wash liquid is fed to reslurrying compartments 216 and 218 via nozzles at 222 and 224. Wash liquid and mother liquor, schematically represented by an arrow 226, exits cake 228 via a conical screen section 230 along an outer side of dewatering compartment 220. Screen section 230 is flanked on opposite sides by conical solid bowl sections 232 and 234 defining outer walls of reslurrying compartments 216 and 218. Compartments 216, 218 and 220 are defined in part by gate or baffle elements 236. Bowl 212 may include an output cylinder 238 optionally provided with one or more additional dewatering compartments 240 and 242 and one or more additional reslurrying compartments 244. FIG. 12 diagrammatically represents flood wash reslurrying by showing slurry levels 246, 248, and 250 in reslurrying compartments 216, 218, and 244.

Figure 13:
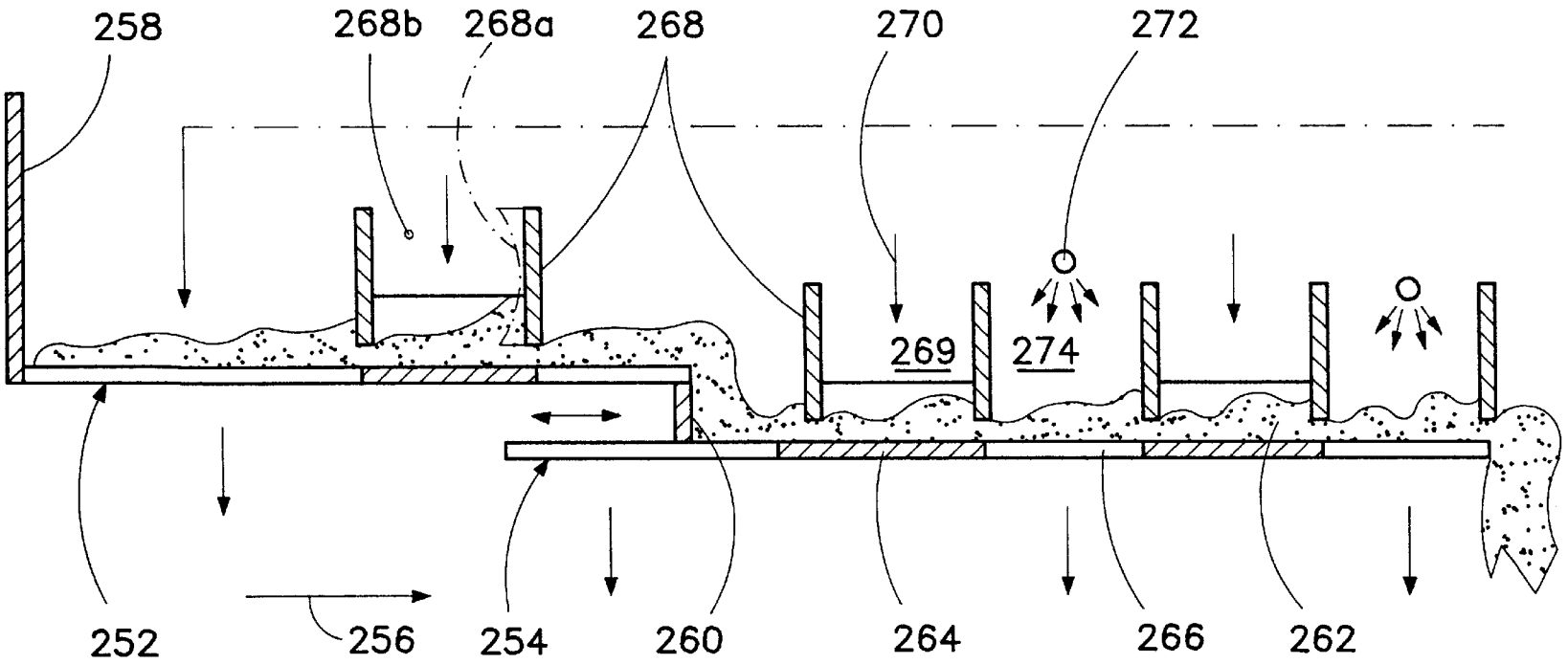
FIG. 13 is a schematic longitudinal cross-sectional view of a two-stage pusher-type centrifuge in accordance with the present invention.

FIG. 13 depicts a pusher-type centrifuge including a cylindrical first basket 252 and a cylindrical second basket 254 disposed downstream of the first basket along a cake flow path 256. Basket 252 has a smaller diameter than basket 254. The centrifuge also includes pushers 258 and 260 for pushing a particulate cake layer 262 along baskets 252 and 254, respectively. Baskets 252 and 254 have a plurality of circumferentially extending solid bowl sections 264 alternating with circumferentially extending perforate screen sections 266, while a plurality of circumferential and radial gates 268 are disposed at junctions between adjacent solid bowl and perforate screen sections 264 and 266. Flood wash liquid is supplied to reslurrying compartments 269 by nozzles, as indicated by arrows 270, while spray nozzles 272 may be provided in dewatering compartments 274 for spraying cake 262 during dewatering or desaturation thereof.

Tests conducted on an 18-in diameter screenbowl show promise of the above-described reslurrying-and-separation design. This is especially suitable for screenbowl operating at high flow rate and low centrifugal gravity. As much as 4–6% washing efficiency improvement can be obtained with the reslurrying-and-separation arrangement as compared to a conventional washing arrangement with a screenbowl despite the open screen area is much reduced.

Multiple reslurrying and separation stages in a single pusher centrifuge may be carried out for single-stage pushers as well as multi-stage pushers, each with a large diameter basket with alternating stages reciprocating, and all the stages also rotating concurrently.

Figure 14:
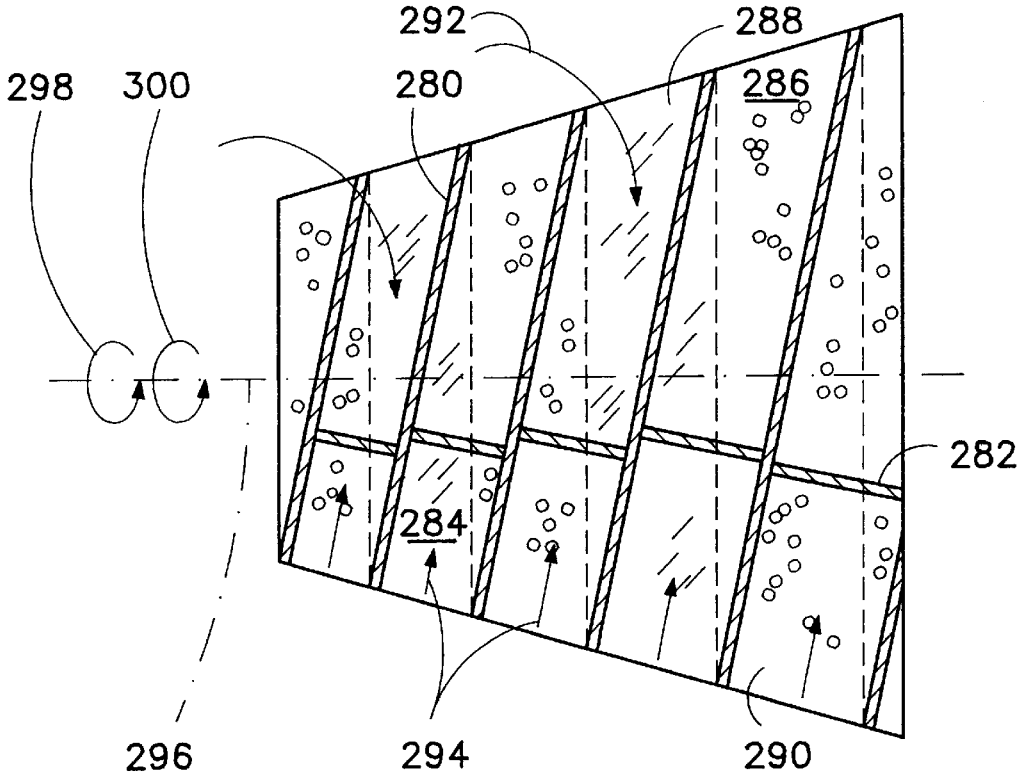
FIG. 14 is a schematic unwrapped or developed view of a conical-screen centrifuge in accordance with the present invention, showing the placement of gates relative to alternating cylindrical imperforate sections and screen sections.

FIG. 14 is an unwrapped or developed view of a conical-screen centrifuge having a single-lead conveyor 280. A series of baffles or gates 282 are provided substantially perpendicular to the conveyor lead or blade for separating the screen area or conical wall of the centrifuge into reslurrying compartments 284 and dewatering compartments 286 alternating therewith. The conical wall of the centrifuge is formed with circumferentially extending solid or imperforate sections or bands 288 interleaved with circumferentially extending perforated screen sections or bands 290. Wash liquid is introduced into the reslurrying compartments, as indicated by arrows 292. Cake moves along a helical path, as indicated by cake flow arrows 294, as the conveyor 280 and the conical centrifuge wall rotate at differential speeds about an axis 296, as indicated by arrows 298 and 300.

The arrangement of FIG. 14 also applies to conical-screen centrifuges with multiple-lead conveyors.

Figure 15:
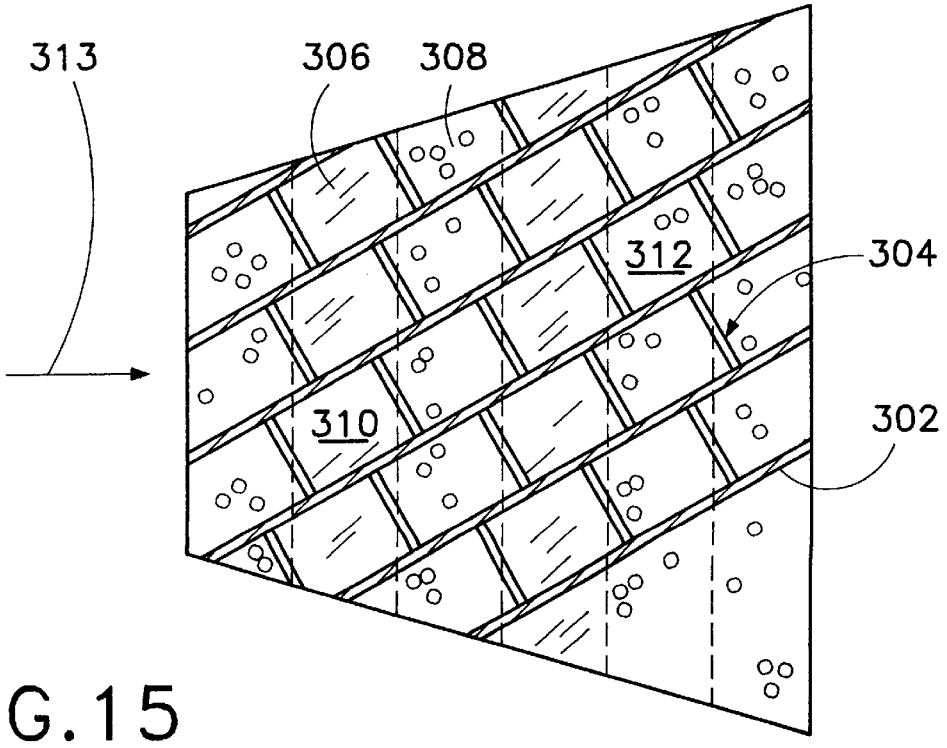
FIG. 15 is a schematic unwrapped or developed view of another conical-screen centrifuge in accordance with the present invention, showing the placement of gates relative to alternating cylindrical imperforate sections and screen sections.

FIG. 15 shows a conveyor with 4 discrete leads or blades 302 which do not wrap 360° about the conveyor hub (not shown). Gates 304 and interleaved cylindrical solid wall and perforate sections 306 and 308 are provided to form alternating reslurrying and dewatering compartments 310 and 312. Cake flows in an approximately longitudinal direction as indicated by an arrow 313.

Figure 16:
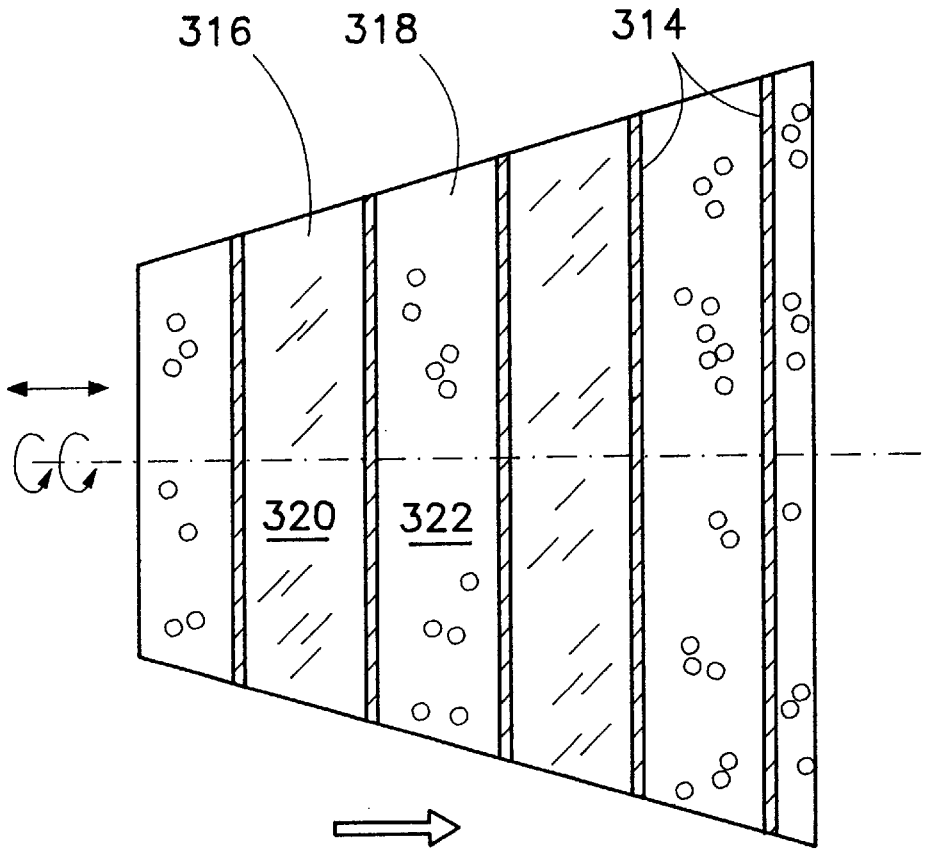
FIG. 16 is a schematic unwrapped or developed view of yet another conical-screen centrifuge in accordance with the present invention, showing the placement of gates relative to alternating cylindrical imperforate sections and screen sections.
Figure 17:
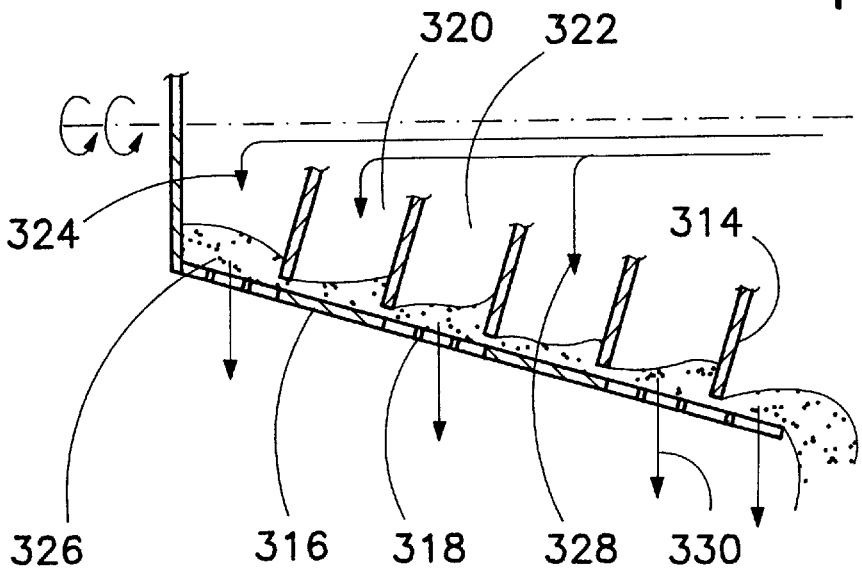
FIG. 17 is a schematic longitudinal cross-sectional view taken along line XVI—XVI in FIG. 16.

As illustrated in FIGS. 16 and 17, a vibrating conical-screen conveyor with a plurality of annular or circumferentially oriented rotating gates or baffles 314. Together with interleaved cylindrical solid wall sections 316 and cylindrical perforate or screen wall sections 318, baffles 314 define a series of alternating reslurrying compartments 320 and dewatering compartments 322. A feed slurry 324 is delivered to an input compartment 326 of the machine, where bulk filtration and cake formation occurs. A wash liquid is provided to reslurrying compartments 320, as indicated by arrows 328. Filtrate 330 exits the centrifuge through screen sections 318.

In the embodiments of FIGS. 14, 15, 16, and 17, the last gate towards the cake discharge end of the machine, at the large diameter end of the conical screen area, provides a means for controlling the retention/residence time of final cake dewatering at maximum centrifugal gravity before the cake is discharged from the machine.

Thus, reslurrying and dewatering as described herein is effective in enhancing the removal of impurities in all types of conical-screen centrifuges, whether including large cone angles with centrifugal gravity driving the cake down the cone or shallow cone angles with a conveyor or vibration driving the cake.

Reslurrying and separation insitu in a single centrifuge provides an important technology allowing substantial purification of difficult-to-wash cake which otherwise could not have achieved with conventional spray or flood wash.

Any of the gates described herein which partition a screening-type centrifuge into reslurrying and dewatering compartments may be formed with a concave profile on an upstream side (as defined by cake flow). More particularly, any such gate which is oriented substantially perpendicularly to the direction of cake flow, for example, a gate 268 in FIG. 13, may be formed on an upstream side with a substantially cylindrical concave surface 268*a* extending about an axis 268*b* which is parallel to the cake layer and perpendicular to the cake flow direction, with the result that cake particles in an upper (radially inner) portion of the moving cake layer are turned back towards the interior of the compartment on the upstream side of the respective gate.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. A centrifuge comprising partition elements forming a series of compartments disposed along a cake flow path, said centrifuge having a bowl including a first screen section, a second screen section and a solid bowl section therebetween, a first compartment of said series of compartments being defined on an outer side at least partially by said first screen section to enable dewatering of particulate material traveling through said first compartment along said cake flow path, a second compartment of said series of compartments disposed downstream of said first compartment along said cake flow path being defined on an outer side by said solid bowl section, said compartment having a liquid feed for reslurrying or resuspending the particulate material in said second compartment, a third compartment of said series of compartments disposed downstream of said second compartment along said cake flow path being defined on an outer side at least partially by said second screen section to enable dewatering of particulate material traveling through said third compartment along said cake flow path.

2. The centrifuge defined in claim 1 wherein said partition elements include a plurality of gates extending outwardly from a hub of centrifuge.

3. The centrifuge defined in claim 2, wherein said bowl has a conical beach section, said compartments being disposed at least partially along said beach section.

4. The centrifuge defined in claim 3 wherein said bowl includes a cylindrical section located downstream of said conical beach section along said cake flow path, at least one of said compartments being disposed along said cylindrical section.

5. The centrifuge defined in claim 2 wherein said gates are adjustable to vary a distance between outer edges of said gates and an inner surface of a centrifuge wall, thereby metering the cake flow to provide a desired cake thickness.

6. The centrifuge defined in claim 2 wherein said bowl has a conical beach section and a cylindrical section located downstream of said conical beach section along said cake flow path, said compartments being disposed solely along said cylindrical section.

7. The centrifuge defined in claim 2, further comprising a helical conveyor, said gates extending substantially perpendicularly to a wrap of said conveyor.

8. The centrifuge defined in claim 2, further comprising a helical conveyor, said gates being connected to said conveyor, said gates extending in planes substantially perpendicular to said hub.

9. The centrifuge defined in claim 2 wherein at least one of said gates is concave on an upstream side thereof.

10. The centrifuge defined in claim 1 wherein said solid bowl section is one of a plurality of circumferentially extending solid bowl sections and wherein said first screen section and said second screen section are circumferentially extending perforate screen sections, said solid bowl sections alternating with said screen sections along said cake flow path, also comprising a conveyor with a plurality of interleaved screw wraps, said screw wraps extending at an angle relative to said solid bowl sections and said perforate screen sections, said compartments being defined in part by a plurality of gates extending outwardly from a hub of the centrifuge, said gates being connected to said wraps.

11. The centrifuge defined in claim 10 wherein said gates are equispaced, said bowl being provided with substantially solid triangular sections contiguous with at least one of said solid bowl sections to render said second compartment completely solid or imperforate along the outer side thereof.

12. The centrifuge defined in claim 10 wherein said gates are spaced so that said second compartment is completely solid or imperforate along the outer side thereof.

13. The centrifuge defined in claim 10 wherein said gates are circumferential and lie in planes substantially perpendicular to said hub.

14. The centrifuge defined in claim 1 wherein said bowl includes a cylindrical basket and pushers for pushing cake along said basket, said solid bowl section being one of a plurality of circumferentially extending solid bowl sections and said first screen sections and said second screen section being circumferentially extending perforate screen sections, said solid bowl sections alternating with said screen sections along said cake flow path, a plurality of circumferential and radial gates being disposed at junctions between adjacent ones of said solid bowl sections and said perforate screen sections.

15. The centrifuge defined in claim 14 wherein said basket has a plurality of stages having increasing diameters in a direction of cake flow along said cake flow path, also comprising pushers for pushing cake from one of said stages to a succeeding one of said stages.

16. The centrifuge defined in claim 1, further comprising spray nozzles in said first compartment and said third compartment for spraying the particulate material during dewatering thereof in said first compartment and said third compartment.

17. The centrifuge defined in claim 1, further comprising an additional compartment located upstream of said first compartment along said cake flow path for reslurrying particulate material, also comprising a clarifier pool compartment located upstream of said additional compartment along said cake flow path and a beach area between a clarifier pool in said clarifier pool compartment and said additional compartment, liquid being returned from particulate material on said beach area to said clarifier pool.

18. A centrifuge comprising partition elements forming a plurality of compartments disposed along a cake flow path, said centrifuge having a bowl including a solid bowl section and a screen section a first compartment of said plurality of compartments being defined on an outer side by said bowl section, said first compartment having a liquid feed for reslurrying or resuspending the particulate material in said first compartment, a second compartment of said plurality of compartments being disposed downstream of said first compartment along said cake flow path, said second compartment being defined on an outer side at least partially by said screen section to enable dewatering of particulate material traveling through said second compartment along said cake flow path.

19. The centrifuge defined in claim 18 wherein a third compartment of said plurality of compartments is disposed downstream of said second compartment along said cake flow path and has a liquid feed for reslurrying or resuspending the particulate material in said third compartment, said bowl being imperforate along an outer side of said third compartment, a fourth compartment of said plurality of compartments being disposed downstream of said third compartment along said cake flow path, said bowl having a screen section alone an outer side of said fourth compartment to enable dewatering of particulate material traveling through said fourth compartment along said cake flow path.

20. The centrifuge defined in claim 18 wherein said first compartment holds a clarifier pool and includes a beach area, said liquid feed being disposed downstream of said beach area along said cake flow path.

21. The centrifuge defined in claim 18 wherein said partition elements include a plurality of gates extending outwardly from a hub of the centrifuge.

22. A centrifuge comprising a bowl and a plurality of partitions defining a series of compartments disposed along a cake flow path, said compartments including a dewatering compartment followed by a reslurrying compartment in turn followed by another dewatering compartment.

23. A centrifuge comprising partition elements forming a plurality of substantially closed compartments disposed along a cake flow path and sufficiently open to permit passage of cake along said cake flow path, said centrifuge having a bowl including a solid bowl section and a screen section, a first compartment of said plurality of compartments being defined on an outer side at least partially by said screen section to enable dewatering of particulate material traveling through said first compartment along said cake flow path a second compartment of said plurality of compartment being disposed downstream of said first compartment along said cake flow path said second compartment being defined on an outer side by said solid bowl section, said second compartment having a liquid feed for reslurrying or resuspending the particulate material in said second compartment.

* * * * *